United States Patent [19]

Rudolf et al.

[11] Patent Number: 4,917,016

[45] Date of Patent: Apr. 17, 1990

[54] WARHEAD CASING HAVING PERIPHERAL COATINGS FOR THE PROJECTILE FORMATION BY MEANS OF EXPLOSIVE

[75] Inventors: Karl Rudolf, Schrobenhausen; Siegfried Rhau, Neunkirchen, both of Fed. Rep. of Germany

[73] Assignee: DIEHL GmbH & Co., Nuremberg, Fed. Rep. of Germany

[21] Appl. No.: 293,371

[22] Filed: Jan. 4, 1989

[51] Int. Cl.[4] ..... F42B 13/18

[52] U.S. Cl. ..... 102/476; 102/493; 102/501

[58] Field of Search ..... 102/306, 476, 491, 492, 102/493, 501

[56] References Cited

U.S. PATENT DOCUMENTS

| | | | |
|---|---|---|---|
| 34,789 | 3/1862 | Wickersham | 102/493 |
| 90,164 | 5/1869 | Gibson | 102/493 |
| 3,447,463 | 6/1969 | Lavine | 102/492 |
| 3,757,693 | 9/1973 | Sheg | 102/493 |

FOREIGN PATENT DOCUMENTS

| | | | |
|---|---|---|---|
| 2533585 | 2/1977 | Fed. Rep. of Germany | 102/476 |
| 3506225 | 8/1986 | Fed. Rep. of Germany | 102/476 |
| 130692 | 8/1919 | United Kingdom | 102/501 |
| 1342093 | 12/1973 | United Kingdom . | |
| 1481951 | 8/1977 | United Kingdom . | |
| 2033552 | 8/1982 | United Kingdom . | |

*Primary Examiner*—Stephen C. Bentley

*Attorney, Agent, or Firm*—Scully, Scott, Murphy & Presser

[57] ABSTRACT

A warhead casing containing an explosive charge for the formation of projectiles, and in which the casing has portions with notches formed therein to facilitate the formation of splinters or fragments in addition to the projectiles. The notches may be formed in the outside surface, inside surface or both inside and outside surfaces of the casing to provide splinters of specific sizes and shapes optimized for the attacking of specific types of targets.

7 Claims, 2 Drawing Sheets

WARHEAD CASING HAVING PERIPHERAL COATINGS FOR THE PROJECTILE FORMATION BY MEANS OF EXPLOSIVE

BACKGROUND OF THE INVENTION

1. Field of the Invention

The invention relates to a warhead casing having peripheral coverings for the projectile formation by means of explosive and wherein the casing includes portions with notches formed therein so as to facilitate the formation of splinters or fragments.

For combatting radar stations a warhead is desirable which has, besides explosive-formed projectiles, also a fragmentation effect.

2. Discussion of the Prior Art

Known from the disclosure of DE-OS 22 05 074 is an explosive body having projectile-forming coatings and splinter elements. The splinter elements consist of balls which butt against casing portions and are surrounded by explosive. Such splinters are cost-intensive. Also the production is complicated, since the splinters have to be adjusted by auxiliary devices, in order to be able to embed them in explosive.

SUMMARY OF THE INVENTION

Accordingly, it is an object of the invention to design a warhead casing in a simple and more cost-effective manner in such a way that sufficient and adequately heavy splinters are produced upon the detonation of the warhead.

It is material to the invention that, after the disintegration of the warhead casing, geometrically defined splinters are present, so that sufficient energy is available even over fairly great ranges of about 20 m.

In accordance with a particular inventive feature a simple pre-fragmentation of the warhead casing is possible in that the notches are formed in the exterior surface of the warhead casing.

The same advantage also exists in accordance with a further feature in that notches are formed in the interior surface of the casing.

When notches are formed in both the exterior and interior surfaces of the casing, the fracturing effect which is to be performed by the explosive is determinable by appropriate depths for the notches on the outside and inside of the warhead casing.

In accordance with further features various arrangements of the notches may be employed on the casing in order to be able to produce splinters of specific size and shape.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1A:
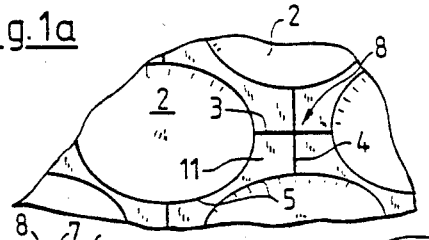
FIG. 1*a* and FIG. 1*b* illustrate, respectively, in a partial view and in a cross-section, a warhead casing.
Figure 1B:
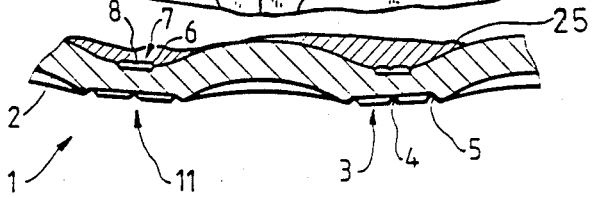

In accordance with FIGS. 1*a* and 1*b* a warhead casing 1 is provided, by a suitable deformation procedure, with coatings 2 and with notches 3–8. The coatings 2 are surrounded on the outside of the casing 1 with the notches 5, 6. The crosswise-arranged notches 3, 4 are arranged on the outside of the casing 1.

The interior of the warhead casing 1 is filled, in any suitable manner with an explosive 25.

Figure 2:
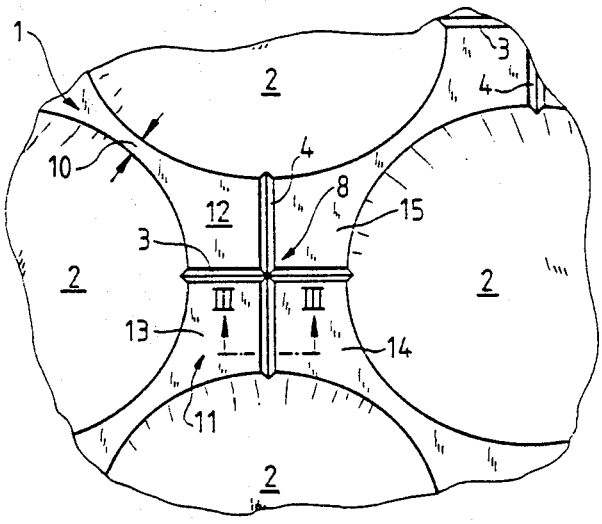
FIGS. 2 to 5 show various kinds of embodiments of notches with regard to coatings of the warhead casing in accordance with FIG. 1 with partial sections in accordance with FIGS. 2 and 4.
Figure 3:
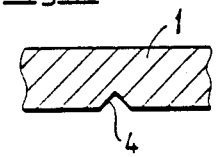

In accordance with FIG. 2 the coatings 2 are arranged at a mutual spacing 10 on the warhead casing 1. The casing portion 11 enclosed by the coatings 2 is provided with the intersecting notches 3, 4 (FIG. 3). Upon the detonation of the explosive 25, from the coatings 2 there are formed explosive-formed projectiles. In addition, by reason of the notches 3, 4 geometrically defined individual splinters 12 and 15 exist.

Figure 4:
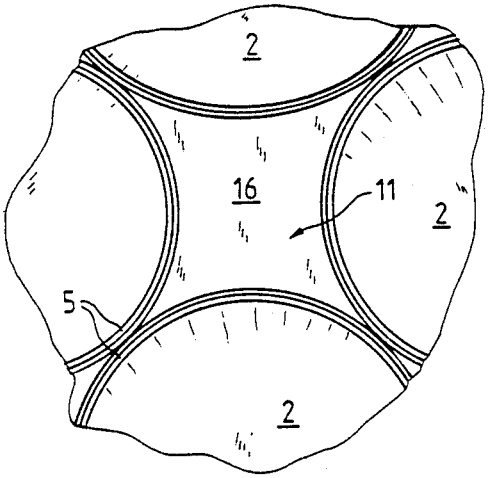

In accordance with FIG. 4 the coatings 2 are surrounded circumferentially with the circular notches 5. These notches 5 mutually contact one another. In this way, upon the disintegration of the warhead casing 1, there is produced a geometrically defined splinter 16.

Figure 5:
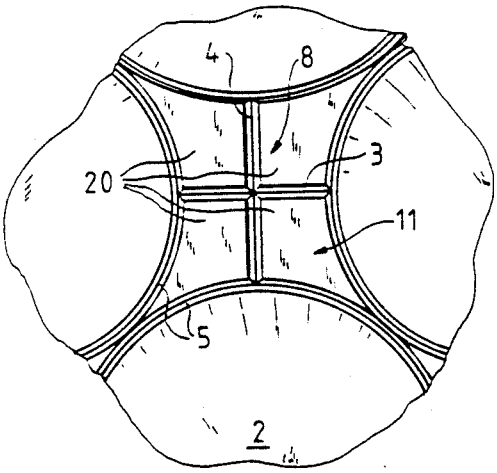

In accordance with FIG. 5, the notches 3 through 5 are arranged pursuant to the pattern shown in FIGS. 1*a* and 1*b*. In this manner, there are formed four geometrically defined splinters 20.

We claim:

1. A warhead having a casing containing an explosive charge, said casing integrally comprising peripheral plate-like portions and splinter-forming portions between the plate-like portions; each said plate-like portion being explosively deformable into a projectile by the charge; peripheral notches formed in the casing surrounding each said plate-like portion; said peripheral notches touching each other between the plate-like portion so that each splinter forming portion is discrete and is surrounded by a group of said plate-like portions, or parts located in close proximity to each other so that each splinter-forming portion is substantially surrounded by a group of said plate-like portions and is connected to others of the splinter-forming portions by narrow connecting portions extending between said proximal parts, said splinter-forming portions being traversed by further cross-shaped notches formed in the casing, and further notches being arranged centrically between and connecting with the peripheral notches of groups of four of the plate-like portions.

2. A warhead as claimed in claim 1, wherein said connecting portions are smaller than the plate-like portions and are arranged to form splinters of predetermined size upon explosion of the charge.

3. A warhead as claimed in claim 1, wherein said plate-like portions are circular.

4. A warhead as claimed in claim 1, wherein said further notches are formed in the outside surface of the casing.

5. A warhead as claimed in claim 1, wherein said further notches are formed in the inside surface of the casing.

6. A warhead casing as claimed in claim 1, wherein said further notches are formed in the outside and the inside surfaces of the casing.

7. A warhead as claimed in claim 1, wherein each said plate-like portion is concavely dished in cross-section.

* * * * *